US006761545B1

(12) United States Patent
Witham et al.

(10) Patent No.: US 6,761,545 B1
(45) Date of Patent: Jul. 13, 2004

(54) SCROLL COMPRESSOR WITH FLOW RESTRICTION AND BACK PRESSURE CHAMBER TAP

(75) Inventors: Robert Carl Witham, Arkadelphia, AR (US); Gregory William Hahn, Arkadelphia, AR (US); Gene Michael Fields, Arkadelphia, AR (US); Thomas Robert Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/335,401

(22) Filed: Dec. 31, 2002

(51) Int. Cl.[7] ..... F04C 18/00
(52) U.S. Cl. ..... 418/55.5; 418/57
(58) Field of Search ..... 418/55.5, 57, 55.2

(56) References Cited

U.S. PATENT DOCUMENTS 6,077,057 A * 6/2000 Hugenroth et al. ..... 418/55.5
6,203,299 B1 * 3/2001 Williams et al. ..... 418/55.5
6,217,302 B1 * 4/2001 Sun et al. ..... 418/55.5
6,309,197 B1 * 10/2001 Bush et al. ..... 418/55.5
6,527,528 B1 * 3/2003 Barito et al. ..... 418/55.5
6,554,592 B1 * 4/2003 Sun et al. ..... 418/55.5

FOREIGN PATENT DOCUMENTS

JP 05001677 A * 1/1993 ..... F04C/12/02

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

Scroll compressors include a tap for communicating a compressed refrigerant to a back pressure chamber to resist a separating force. A restriction is placed within this tap to slow build-up of the back pressure chamber at start-up. Further, the restriction smoothes out any fluctuations in the back pressure force as the pressure in the compression chamber from which the refrigerant is tapped may fluctuate.

14 Claims, 2 Drawing Sheets

SCROLL COMPRESSOR WITH FLOW RESTRICTION AND BACK PRESSURE CHAMBER TAP

BACKGROUND OF THE INVENTION

This invention relates to a scroll compressor having a restriction in the back pressure chamber tap to provide more control over the operation of the back pressure chamber.

Scroll compressors are becoming widely utilized in refrigerant compression applications. In a scroll compressor, opposed non-orbiting and orbiting scroll members face each other. Each of the scroll members have a base and a generally spiral wrap extending from the base. The wraps interfit to define compression chambers. The orbiting scroll is caused to orbit relative to the non-orbiting scroll, and compression chambers defined between the wraps are reduced in size to compress an entrapped refrigerant.

The scroll compressor combination generally includes one of the two members being able to move for a limited axial distance relative to the other. The compression of the refrigerant between the wraps presents a separating force tending to force the two scroll members away from each other. Historically, this separating force has been resisted by tapping a compressed refrigerant to a "back pressure chamber" defined behind the base of one of the two scroll members. The back pressure chamber creates a force forcing the base of the axially movable scroll member toward the other scroll member, thus resisting the separating force.

While the use of the back pressure chamber does address the separating force issue, there are certain challenges that remain. As one challenge, it may sometimes be desirable to not have the back pressure chamber operable for a period of time at start-up of the compressor. As an example, under certain conditions, it may be difficult to begin movement of the compressor members. In such a situation, it would be desirable to not have the back pressure chamber operable for a short period of time after start-up. In this way, the scroll members are not in contact with each other, and there will be leakage reducing the load on a motor for driving the orbiting scroll for a period of time.

Another challenge with back pressure chambers is that during operation, there is some fluctuation in the pressure at the point in the compression chambers from which the back pressure chamber refrigerant is tapped. These fluctuations cause fluctuations in the back pressure force, which may result in somewhat non-smooth operation. Furthermore, the fluctuations in pressure also result in high pressure refrigerant flowing from the compression chambers to the back pressure chamber. Since the back pressure chamber is at a lower pressure, this gas gets expanded, then later recompressed when the pressure tap moves to a lower pressure chamber. This recompression results in a power loss. Because the restrictor minimizes the flow of gas, it also minimizes the power loss due to recompression.

SUMMARY OF THE INVENTION

The present invention presents a tap for back pressure refrigerant which has a restriction. The restriction provides a dual benefit. First, the restriction resists flow of refrigerant at start-up such that there will be a period of time after start-up before the back pressure chamber is fully operational. This provides a reduction of load at start-up. Further, when fluctuations in pressure occur during operation of, the compressor, the restrictions limit the back and forth movement of the refrigerant thus tending to level out any such fluctuations.

In one embodiment, a simple slip fit pin is inserted into the passage to provide a restriction. In another embodiment, a pin is provided with a groove. Other embodiments include a dowel with a small orifice, a hollow tube having a ball, a porous member, a screw with a slot in its threads, etc.

In general, the various restrictions provide the benefit such as mentioned above.

These and other features of the present invention may be best understood from the following specification and drawings, the following of which is a brief description.

DETAILED DESCRIPTION OF THE PREFERRED EMBODIMENT

Figure 1:
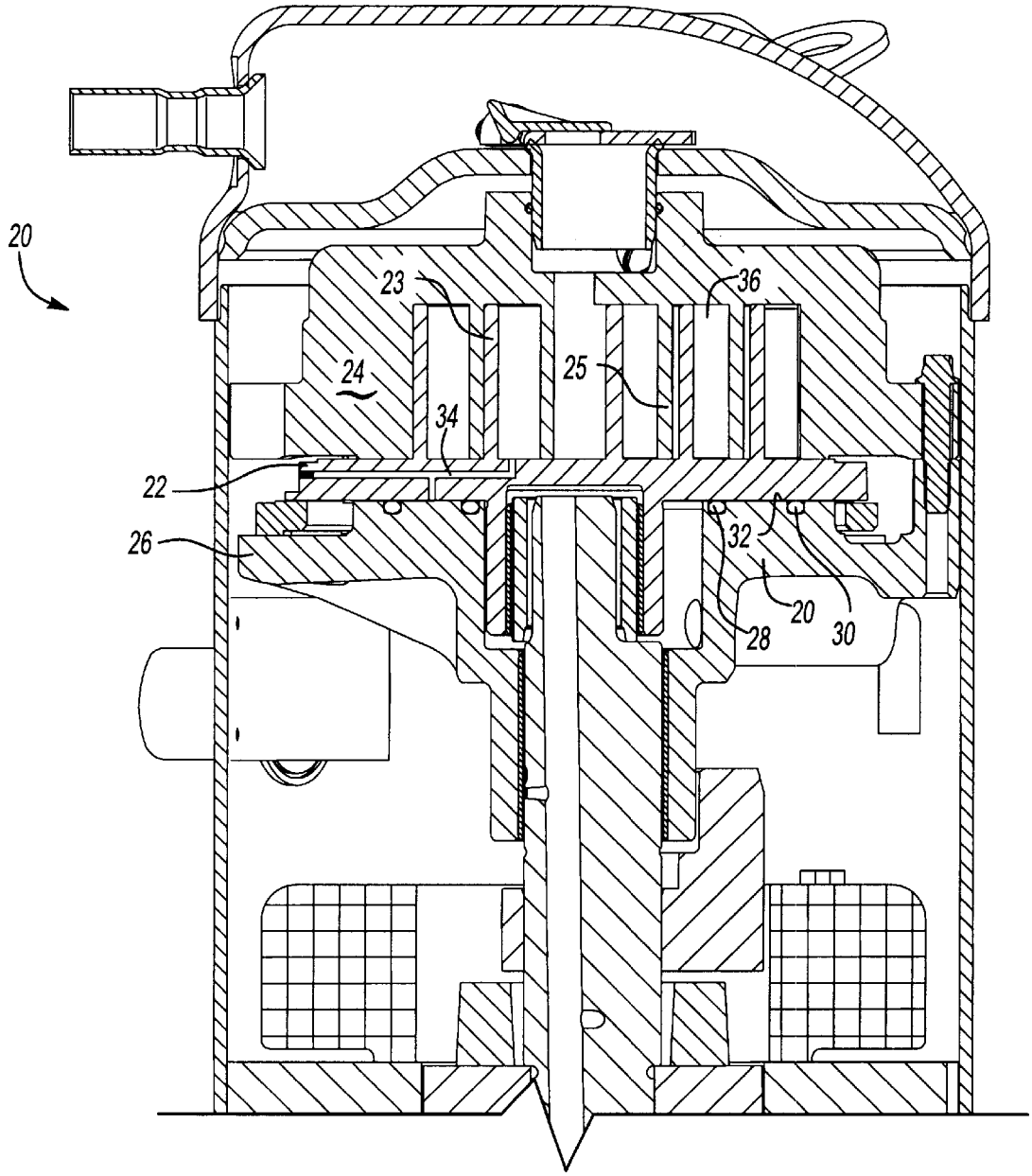
Fig-1 PRIOR ART
FIG. 1 is a cross-sectional view of a prior art scroll compressor incorporating the present invention.

A scroll compressor 20 is illustrated in FIG. 1 having an orbiting scroll 22 with wraps 23. A non-orbiting scroll 24 includes its wraps 25. As known, the wraps 23 and 25 interfit to define compression chambers. The crankcase 26 supports the orbiting scroll 22. Seals 28 and 30 define a back pressure chamber 32 rearward of the base of the orbiting scroll 22. A tap 34 taps refrigerant from an intermediate pressure chamber 36 to the back pressure chamber 32. This structure is generally as known. In the prior art, these structures had problems such as mentioned above.

Figure 2:
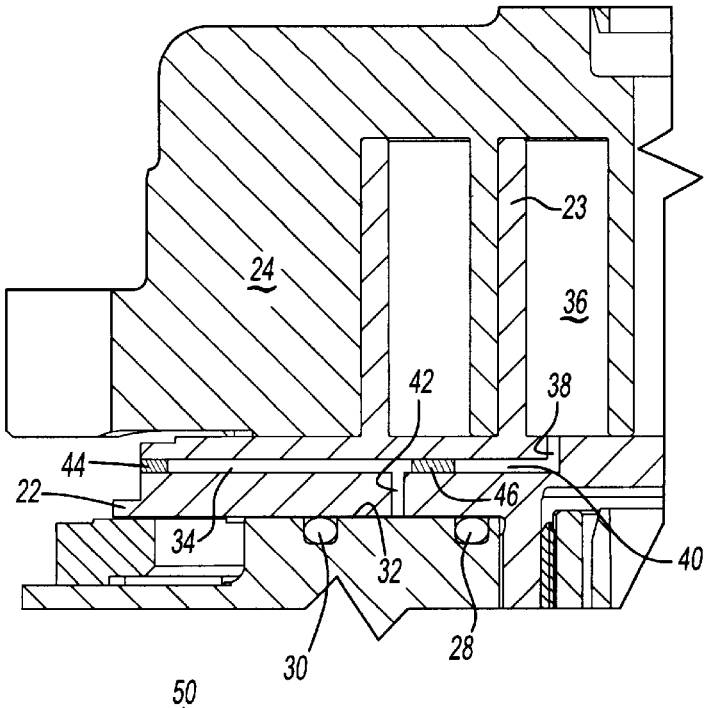
FIG. 2 is a cross-sectional view showing the FIG. 1 embodiment on an enlarged portion.

As shown in FIG. 2, a first tap portion 38 communicates the pressure from the chamber 36 to a crossing tap 40 which in turn communicates with the tap portion 42 extending through the back pressure chamber 32. A plug 44 is typically positioned to plug the end of the passage 34. To form the complex passage, holes are generally drilled at 38, 42 and 34. The hole 34 is then plugged by the plug 44. As shown in this embodiment, a slip fit pin 46 is positioned within the passage 34 to restrict the flow of refrigerant from the first tap portion 38 to the tap portion 42. There is clearance between passage 34 and the outer diameter of pin 46. During operation, this will cause a slow build-up of the pressure in the back pressure chamber 32 reducing the load on the compressor at start-up. Moreover, fluctuations in the back pressure chamber pressure 32, as the pressure in the chamber 36 varies, will also be reduced.

Figure 3:
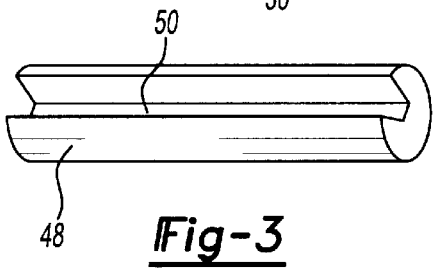
FIG. 3 shows a second embodiment restriction.

FIG. 3 shows another embodiment 48 wherein the slip fit pin has a groove 50 to provide a flow passage. By sizing the passage 50, the present invention allows a designer to achieve an optimum flow restriction.

Figure 4:
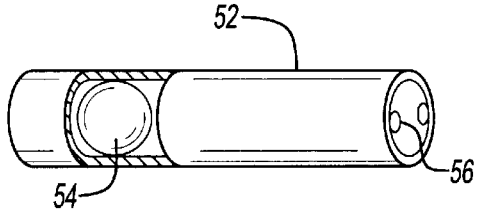
FIG. 4 shows another restriction embodiment.

FIG. 4 shows another embodiment 52 wherein a ball 54 is generally movable within the hollow tube. End stops 56 are formed at each end of the tube. Refrigerant can flow through the tube 52, but is restricted by the ball 54.

Figure 5:
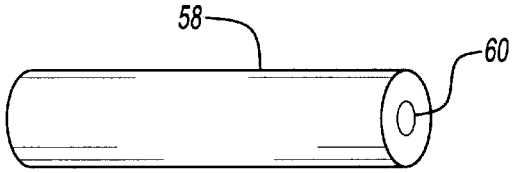
FIG. 5 shows yet another restriction embodiment.

FIG. 5 shows another embodiment 58 which is generally a dowel plug having a small restriction orifice 60 at its inner periphery.

Figure 6:
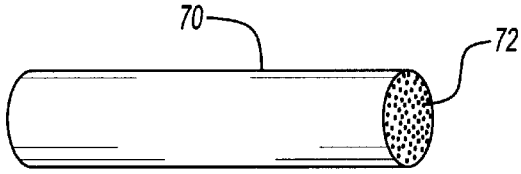
FIG. 6 shows another embodiment.

FIG. 6 shows another embodiment 70 wherein the restriction is formed of a porous material having openings such as schematically shown at 72. Examples of ways to form the porous materials would be utilizing sintered metal, or other porous "filter" materials.

Figure 7:
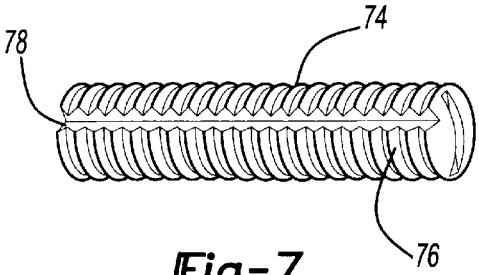
FIG. 7 shows another embodiment.

FIG. 7 shows an embodiment 74 formed of a screw, having a thread 76 with a cut passage 78 along the length of the thread. This member could thus be threaded into the opening, ensuring desired positioning. Other types of labyrinth seals may also be utilized for this purpose.

Figure 8:
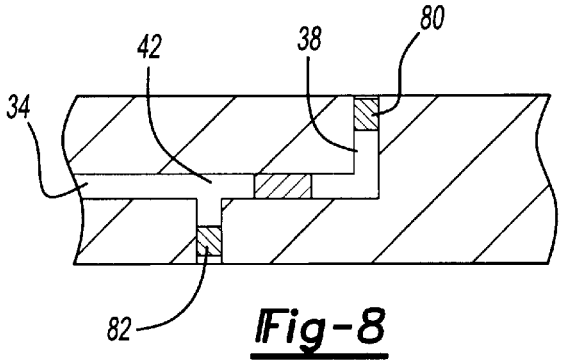
FIG. 8 shows various locations for the restriction.

FIG. 8 shows embodiments 80 and 82 the restriction is placed in other locations in the passages. Alternatively, several restrictions such as are illustrated in FIG. 8 could be utilized.

In general, the restriction thus provides a restriction on a portion of the passage 34, but not the entirety of the passage 34. This allows the designer to achieve the desired amount of restriction. Moreover, it would be difficult in many applications to form the passage 34 of a very limited size, due to machining challenges. Further, it would be difficult to form various diameters within the passage 34 due to machining challenges. Thus, the provision of a separate plug element or restriction into the passage 34 provides valuable benefits.

While the proposed invention is shown in the tap for a scroll compressor having its back pressure chamber behind the orbiting scroll, it is also well known in the scroll art to have back pressure chambers behind the non-orbiting scroll. This invention provides benefits as fully apparent to compressors with a back pressure chamber behind the non-orbiting scroll. Thus, the scope of this invention is not limited to scroll compressors wherein the back pressure chamber is defined behind the non-orbiting scroll, but rather extends to scroll compressors wherein the back pressure chamber is also defined behind the non-orbiting scroll.

Although preferred embodiments of this invention have been disclosed, a worker of ordinary skill in this art would recognize that certain modifications come within the scope of this invention. For that reason, the following claims should be studied to determine the true scope and content of this invention.

What is claimed is:

1. A scroll compressor comprising:

a non-orbiting scroll member having a base and a generally spiral wrap extending from its base;

an orbiting scroll having a base and a generally spiral wrap extending from its base, said wraps of said orbiting and non-orbiting scrolls interfitting to define compression chambers;

said orbiting scroll being driven to orbit relative to said non-orbiting scroll, to reduce said compression chambers and compress an entrapped refrigerant;

a back pressure chamber defined behind said base of one of said orbiting and non-orbiting scrolls, and a tap from said compression chambers into said back pressure chamber, said tap providing a compressed refrigerant into said back pressure chamber to resist a separating force between said orbiting and non-orbiting scrolls; and a restriction member placed in said tap, refrigerant flowing over said restriction member, and past said restriction member in said tap to reach said back pressure chamber.

2. A scroll compressor as recited in claim 1, wherein said tap is formed through said base of said orbiting scroll, and said back pressure chamber is positioned between said orbiting scroll and a supporting crankcase.

3. A scroll compressor as recited in claim 1, wherein said tap includes a first tap portion extending from said compression chamber into a crossing tap portion, and said restriction being a separate member placed within said crossing passage.

4. A scroll compressor as recited in claim 1, wherein said restriction member is a slip fit pin.

5. A scroll compressor as recited in claim 1, wherein said restriction member is a pin member with a groove at an outer peripheral surface to allow passage of refrigerant.

6. A scroll compressor as recited in claim 1, wherein said restriction member is a hollow tube including an internal element for restricting fluid flow.

7. A scroll compressor as recited in claim 1, wherein said restriction element is a dowel with a central orifice.

8. A scroll compressor as recited in claim 1, wherein said restriction is a porous member.

9. A scroll compressor as recited in claim 1, wherein said restriction is a screw having a channel cut through its thread.

10. A scroll compressor as recited in claim 1, wherein said passage has a generally uniform diameter other than the location of said restriction.

11. A scroll compressor comprising:

a non-orbiting scroll member having a base and a generally spiral wrap extending from its base;

an orbiting scroll having a base and a generally spiral wrap extending from its base, said wraps of said orbiting and non-orbiting scrolls interfitting to define compression chambers;

said orbiting scroll being driven to orbit relative to said non-orbiting scroll, to reduce said compression chambers and compress an entrapped refrigerant;

a back pressure chamber defined behind said base of said orbiting scroll, and a tap from said compression chambers into said back pressure chamber, said tap providing a compressed refrigerant into said back pressure chamber to resist a separating force between said orbiting and non-orbiting scrolls; and a restriction member placed in said tap, said tap including a first tap portion extending from said compression chamber into a crossing tap portion, a crossing tap portion extending to a communicating tap portion which communicates with said back pressure chamber, refrigerant flowing over said restriction member, and past said restriction member in said tap to reach said back pressure chamber.

12. A scroll compressor as recited in claim 11, wherein said restriction is placed in said crossing tap portion.

13. A scroll compressor as recited in claim 11, wherein said restriction is placed on said first tap portion.

14. A scroll compressor as recited in claim 11, wherein said restriction is placed in said communicating tap portion.

* * * * *